US009216420B2

(12) United States Patent
Rieger et al.

(10) Patent No.: US 9,216,420 B2
(45) Date of Patent: Dec. 22, 2015

(54) APPARATUS FOR RESOURCE-FRIENDLY SEPARATION OF MAGNETIC PARTICLES FROM NON-MAGNETIC PARTICLES

(71) Applicant: BASF SE, Ludwigshafen (DE)

(72) Inventors: Reinhold Rieger, Mutterstadt (DE); Imme Domke, Jersey City, NJ (US); Alexej Michailovski, Ludwigshafen (DE); Piyada Charoensirisomboon, Mannheim (DE); David F. Blackwood, Long Valley, NJ (US)

(73) Assignee: BASF SE, Ludwigshafen (DE)

( * ) Notice: Subject to any disclaimer, the term of this patent is extended or adjusted under 35 U.S.C. 154(b) by 154 days.

(21) Appl. No.: 13/886,345

(22) Filed: May 3, 2013

(65) Prior Publication Data

US 2013/0334107 A1 Dec. 19, 2013

Related U.S. Application Data

(60) Provisional application No. 61/644,455, filed on May 9, 2012.

(51) Int. Cl.
*B03C 1/28* (2006.01)
*B03C 1/02* (2006.01)

(52) U.S. Cl.
CPC . *B03C 1/02* (2013.01); *B03C 1/288* (2013.01); *B03C 2201/18* (2013.01)

(58) Field of Classification Search
CPC ..... B03C 1/005; B03C 1/01; B03C 1/02; B03C 2201/18; B03C 1/288
USPC ..... 209/5, 9, 213, 225–227, 228, 230, 232; 210/222, 223, 695
See application file for complete search history.

(56) References Cited

U.S. PATENT DOCUMENTS

| | | | | |
|---|---|---|---|---|
| 3,332,191 | A | 7/1967 | Fischer | |
| 3,489,280 | A | 1/1970 | Israelson et al. | |
| 3,926,789 | A * | 12/1975 | Shubert | 209/8 |
| 4,199,455 | A | 4/1980 | Estabrook | |
| 4,657,666 | A * | 4/1987 | Snook et al. | 209/8 |
| 5,051,199 | A | 9/1991 | Barwise | |
| 5,161,694 | A * | 11/1992 | Yoon et al. | 209/5 |
| 5,496,470 | A * | 3/1996 | Lenhart | 210/222 |
| 6,149,014 | A | 11/2000 | Mankosa et al. | |
| 8,052,875 | B2 * | 11/2011 | Oder et al. | 210/695 |

(Continued)

FOREIGN PATENT DOCUMENTS

| | | |
|---|---|---|
| EP | 0520917 A1 | 12/1992 |
| EP | 1524038 A1 | 4/2005 |

(Continued)

*Primary Examiner* — Joseph C Rodriguez
(74) *Attorney, Agent, or Firm* — Drinker Biddle & Reath LLP

(57) ABSTRACT

An apparatus for separating magnetic particles from a dispersion that includes magnetic particles and non-magnetic particles, the apparatus comprising; at least one arcuate canal forming 90 to 350° of a circular arc through which the dispersion flows, at least one magnet that is movable adjacent to the canal and which forces the magnetic particles into at least one first outlet, and at least one second outlet through which the non-magnetic particles exit the canal, the apparatus further comprising treating the dispersion, or a part of the dispersion, with a hydrophilic liquid, and treating the dispersion, or a part of the dispersion, with a hydrophobic liquid.

17 Claims, 2 Drawing Sheets

(56) References Cited

U.S. PATENT DOCUMENTS

Figure 1:
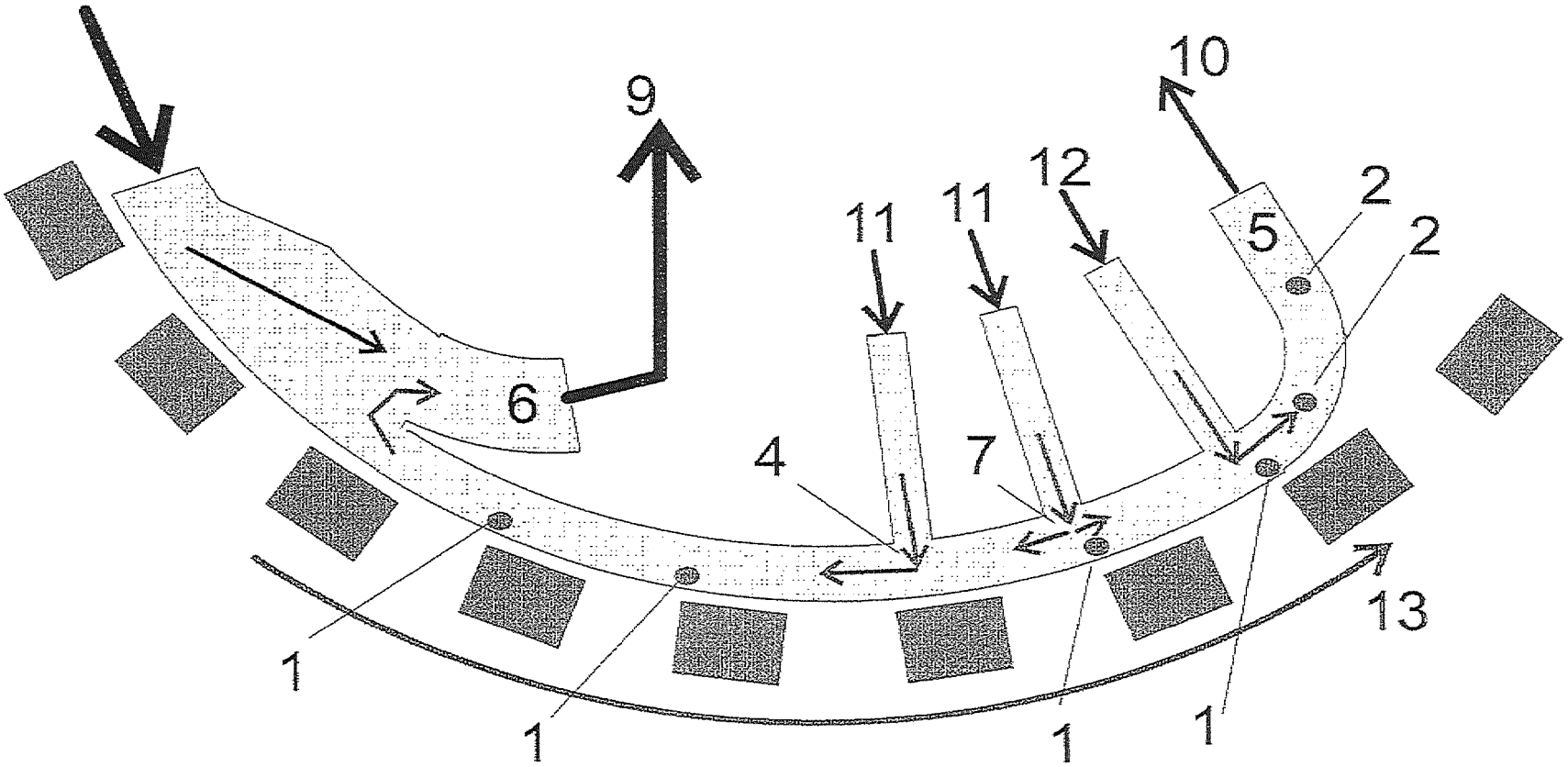

| | | | | |
|---|---|---|---|---|
| 8,377,312 | B2 * | 2/2013 | Domke et al. | 210/695 |
| 8,408,395 | B2 | 4/2013 | Domke et al. | |
| 8,486,270 | B2 * | 7/2013 | Rieger et al. | 210/679 |
| 8,640,876 | B2 * | 2/2014 | Danov | 209/11 |
| 8,840,794 | B2 * | 9/2014 | Danov et al. | 210/695 |
| 2004/0018611 | A1 | 1/2004 | Ward et al. | |
| 2010/0297733 | A1 | 11/2010 | Lin et al. | |
| 2010/0300941 | A1 | 12/2010 | Domke et al. | |
| 2010/0307982 | A1 | 12/2010 | Domke et al. | |
| 2011/0120919 | A1 | 5/2011 | Domke et al. | |
| 2011/0120954 | A1 | 5/2011 | Domke et al. | |
| 2011/0127222 | A1 | 6/2011 | Chang-Yen et al. | |
| 2011/0168618 | A1 | 7/2011 | Danov et al. | |
| 2012/0211403 | A1 * | 8/2012 | Rieger et al. | 209/10 |
| 2014/0027383 | A1 * | 1/2014 | Rieger et al. | 210/695 |

FOREIGN PATENT DOCUMENTS

| | | | |
|---|---|---|---|
| GB | 1029022 | A | 5/1966 |
| SU | 1240451 | A1 | 6/1986 |
| SU | 1470341 | A1 | 4/1989 |
| WO | WO-98/06500 | A1 | 2/1998 |
| WO | WO-2009010422 | A1 | 1/2009 |
| WO | WO-2009030669 | A2 | 3/2009 |
| WO | WO-2009065802 | A2 | 5/2009 |
| WO | WO-2010007075 | A1 | 1/2010 |
| WO | WO-2010007157 | A1 | 1/2010 |
| WO | WO-2010031617 | A1 | 3/2010 |

* cited by examiner

APPARATUS FOR RESOURCE-FRIENDLY SEPARATION OF MAGNETIC PARTICLES FROM NON-MAGNETIC PARTICLES

CROSS-REFERENCE TO RELATED APPLICATIONS

This application claims benefit, under 35 U.S.C. §119(e), to U.S. Provisional Application No. 61/644,455, filed May 9, 2012, which is incorporated herein by reference.

BACKGROUND

The present invention relates to an apparatus for separating magnetic particles from a dispersion comprising these magnetic particles and non-magnetic particles, comprising at least one loop-like canal forming 90 to 350° of a circular arc through which the dispersion flows, at least one magnet that is movable alongside the canal and which forces the magnetic particles into at least one first outlet, and at least one second outlet through which the non-magnetic particles are forced, wherein the apparatus further comprises at least one first means for treating the dispersion or a part of the dispersion with a hydrophilic liquid and at least one second means for treating the dispersion or a part of the dispersion with a hydrophobic liquid. In addition, the present invention relates to the use of the apparatus according to the present invention for separating magnetic particles from a dispersion, comprising these magnetic particles and non-magnetic particles.

Processes and apparatuses for the separation of magnetic constituents from a dispersion comprising these and non-magnetic constituents are already known to the skilled artisan.

WO 2010/031617 A1 discloses a device for separating ferromagnetic particles from a suspension, wherein this device comprises a tubular reactor and a plurality of magnets which are arranged outside the reactor, the magnets being moveable along at least a part of the length of the reactor up to the vicinity of a particle extractor by means of rotary conveyor. The reactor is a linear tube, but is not loop-like. The cleaning of the magnetic fraction is not described.

U.S. Pat. No. 6,149,014 discloses a mill magnet separator and method for separating, wherein the separator comprises a wet drum magnetic separator capable of treating, removing tramp metal from the full flow discharge of a grinding mill having a feed box which provides overflow capacity. Separation of magnetic particles of the mentioned dispersion is achieved by fixed magnets which are arranged at the inner side of a rotating drum. The mentioned document does not disclose any specific arrangement of the apparatus in respect of gravity.

EP 0 520 917 A1 discloses a method and apparatus for magnetic separation. The apparatus comprises a magnetic separator with fixed, low intensity magnets and a rotated drum, which is surrounded by a wall to get a long magnetic separation zone. The mentioned document does not disclose any arrangement of the apparatus in respect of gravity.

U.S. Pat. No. 3,489,280 discloses a magnetic separator having field shaping poles. The separator according to this document is a drum-like separator, wherein fixed magnets are arranged at the inside of the drum which is partly surrounded by a wall. The dispersion flows through this so-built canal. Further magnets are arranged at the opposite side of this channel. The mentioned document does not disclose any arrangement of the apparatus in respect of gravity and no flushing of the magnetic separated fraction is documented.

SU 1240451 A1 discloses a separator for the separation of magnetic particles from a dispersion comprising these and non-magnetic particles by a disk-like magnetic separator, comprising fixed magnets at the outside of the disks. A canal is formed at the inside of the disks and the dispersion to be treated flows through this canal. The magnets are located at alternating positions at both sides of the disk, so that the magnetic layer is dug up by running from one side of the canal to the other side. The magnetic fraction is washed out of the disk-like canal by a clean fluid, but no washing of the magnetic fraction is documented. The mentioned document does not disclose any arrangement of the apparatus in respect of gravity.

SU 1470341 A1 discloses a separator for separating magnetic particles from dispersants comprising these and non-magnetic particles by a drum separator, wherein this drum separator comprises a long way along the drum in which a magnetic field is applied to the dispersion to be separated in order to increase yield and efficiency of magnetic separation.

WO 98/06500 discloses an apparatus and method for separating particles. This apparatus includes means for generating a rotating magnetic field such as a rotating magnetic drum. The canal through which the dispersion to be separated flows is in direct neighborhood to the magnets, wherein it is loop-like or linear. The separation is done by causing a rotation to the particles to be separated, what occurs to coarse particles, and to use this rotation as force to separate the magnetizable particles. It is not disclosed in said document that the whole reactor shall be arranged in respect to gravity in a way to improve separation of magnetic and non-magnetic particles.

EP 1524038 A1 discloses a separator for separating magnetic particles from dispersions comprising these and non-magnetic particles by a loop-like separator that is using magnetic forces to separate magnetic fraction assisted by centrifugal and gravity forces, wherein gravity forces are working across the flow direction due to the horizontal location of the loop and do not efficiently separate non-magnetic constituents from the magnetic constituents. It is not disclosed to clean the magnetic fraction in any way.

DESCRIPTION

In a process for separating values from ores by attaching the values to magnetic particles, in particular to magnetite, to obtain magnetic agglomerates and removing these magnetic agglomerates magnetically, it is crucial that the magnetite or the magnetic material which is used as the carrier for the values can be recycled into the process in order to run the process in an economically advantageous way. Furthermore, in such a process, the agglomerates comprising the value and the magnetic material are preferably treated with an aqueous solution comprising surfactants. This aqueous solution comprising surfactants is then further carried through the process, wherein a very low amount of surfactants sticks to the value and very low amount of the surfactants is attached to the hydrophobic magnetic carrier particles. In order to increase the cost effectiveness of such a process, the surfactant which is used to separate the agglomerates should also be recycled into the process. Furthermore, with recycling the magnetic carrier particles and the surfactant which is used to separate the agglomerates, a process can be designed which is more environmentally friendly. A process, wherein the substrates which are used, for example magnetic material and/or surfactant, are recycled, gives rise to a significantly improved efficiency of the whole process.

It is therefore an object of the present invention to provide an apparatus for separating magnetic constituents from a preferably aqueous dispersion, comprising these magnetic constituents and non-magnetic constituents, in which a very small proportion of non-magnetic constituents shall be separated off, for example by attachment to the magnetic constituents, so as to increase the efficiency of the process.

Furthermore, it is advantageous if a very small proportion of non-magnetic constituents is present in the fraction to be separated off, since, particularly in the separation of naturally occurring ores, the non-magnetic constituents comprise essentially oxidic compounds which in a work-up of the ore mineral by smelting are obtained as slag and have an adverse effect on the smelting process. It is therefore also an object of the present invention to provide a process for separating naturally occurring ores, so that a very small amount of slag is obtained in a subsequent smelting process.

A further object of the present invention is to provide an apparatus which can be operated with low amounts of surfactant and magnetic material which has to be added to the process in each circle. To solve this object, an apparatus should be provided giving rise to the opportunity that surfactant and magnetic material can be recycled at a very high ratio.

These objects are achieved according to the present invention by an apparatus for separating magnetic particles from a dispersion comprising these magnetic particles and non-magnetic particles, comprising at least one loop-like canal forming 90 to 350° of a circular arc through which the dispersion flows, at least one magnet that is movable alongside the canal and which forces the magnetic particles into at least one first outlet, and at least one second outlet through which the non-magnetic particles are forced, wherein the apparatus further comprises at least one first means for treating the dispersion or a part of the dispersion with a hydrophilic liquid and at least one second means for treating the dispersion or a part of the dispersion with a hydrophobic liquid.

The apparatus of the invention serves to separate magnetic constituents from a dispersion comprising these magnetic constituents and non-magnetic constituents. In general, the apparatus can be employed for separating all magnetic constituents from non-magnetic constituents that form dispersion, preferably in water.

The apparatus according to the present invention can preferably be used in two possible embodiments.

According to the first preferred embodiment, the at least one magnetic particle is an hydrophobic bound agglomerate comprising at least one first material that is hydrophobic or treated to be hydrophobic, preferably values that are in general present in naturally occurring ores, and at least one magnetic material that is hydrophobic or treated to be hydrophobic, preferably hydrophobised magnetite. In this first embodiment, the at least one non-magnetic particle being present in the dispersion is at least one second material, preferably the gangue that is in general present in naturally occurring ores. This preferred first embodiment of the present invention is shown exemplarily in FIG. 1.

According to the second preferred embodiment, the at least one magnetic particle is a hydrophobic magnetic material, preferably hydrophobised magnetite that is used for separating values from gangue in naturally occurring ores, particularly preferably magnetite that has been used to provide hydrophobic connected magnetic agglomerates according to the first embodiment. In this second embodiment, the at least one non-magnetic particle being present in the dispersion is at least one first material, preferably the values that are in general present in naturally occurring ores, particularly preferably the values that is hydrophobic or treated to be hydrophobic and that have been present in the hydrophobic connected agglomerates according to the first embodiment of the present invention. This preferred second embodiment of the present invention is shown exemplarily in FIG. 2.

According to a further embodiment of the present invention the apparatus of the invention is preferably used in order to separate magnetic constituents, for example naturally occurring magnetite, from naturally occurring ores, preferably before further work-up of these ores.

In a preferred embodiment of the present invention, the apparatus according to the present invention comprises means to conduct both steps according to the first and the second embodiment one after another. First, magnetic agglomerates are separated from at least one non-magnetic second material, and in a second step, after desagglomeration, at least one magnetic particle that has been present in the magnetic agglomerates is separated form the at least one first material.

In a preferred embodiment, the process of the invention serves to separate aqueous dispersions which originate from the work-up of naturally occurring ores.

In a further preferred embodiment of the process of the invention, the aqueous dispersion to be separated originates from a process for separating at least one first material from a mixture comprising this at least one first material and at least one second material, with the at least two materials being separated from one another by treating the mixture in aqueous dispersion with at least one magnetic particle, resulting in the at least one first material and the at least one magnetic particle agglomerating and thus forming the magnetic constituents of the aqueous dispersion and the at least one second material and the at least one magnetic particle not agglomerating so that the at least one second material preferably forms the non-magnetic constituents of the aqueous dispersion.

The agglomeration of at least one first material and at least one magnetic particle to form the magnetic constituents in general occurs as a result of attractive interactions between these particles.

According to the invention, it is possible, for example, for said particles to agglomerate because the surface of the at least one first material is intrinsically hydrophobic or is hydrophobicized by treatment with at least one surface-modifying substance, if appropriate additionally. Since the magnetic particles likewise either themselves have a hydrophobic surface or are hydrophobicized, if appropriate additionally, said particles agglomerate as a result of the hydrophobic interactions. Since the at least one second material preferably has a hydrophilic surface, the magnetic particles and the at least one second material do not agglomerate. A process for formation these magnetic agglomerates is described, for example, in WO 2009/030669 A1. For all details of this process, reference is expressly made to this publication.

For the purposes of the present invention, "hydrophobic" means that the corresponding particle can have been hydrophobicized subsequently by treatment with the at least one surface-modifying substance. It is also possible for an intrinsically hydrophobic particle to be additionally hydrophobicized by treatment with the at least one surface-modifying substance.

"Hydrophobic" means, for the purposes of the present invention, that the surface of a corresponding "hydrophobic substance" or a "hydrophobicized substance" has a contact angle of >90° with water against air. "Hydrophilic" means, for the purposes of the present invention, that the surface of a corresponding "hydrophilic substance" has a contact angle of <90° with water against air.

According to the present invention at least one hydrophobic liquid is, in general, a liquid that interacts with water as a non mixing partner by forming nonpolar domains, i.e. cells, within the water, i.e. causing a hydrophobic effect. Examples of preferred hydrophobic liquids according to the present invention are selected from the group consisting of aqueous solutions of surfactants, alcohols with long alkyl-chains, for example with 4, to 18, preferably 4, to 15, carbon atoms, and mixtures thereof.

Preferred surfactants are selected from the group consisting of non-ionic, anionic, cationic or hybrid-ionic surfactants and mixtures thereof.

According to the present invention, preferred examples of non-ionic surfactants are selected from the group consisting of fatty alcohol polyglycolethers, preferably fatty alcohol polyethyleneglycolethers and mixtures thereof.

According to the present invention, preferred examples of anionic surfactants are selected from the group consisting of alkylbenzenesulfonates, secondary alkylsulfonates, alpha-olefin sulfonates, fatty alcohol sulfonates, fatty alcohol ether sulfates and mixtures thereof.

According to the present invention, preferred examples of cationic surfactants are selected from the group consisting of stearyltrimethylammonium salts and mixtures thereof.

According to the present invention, preferred examples of hybrid-ionic surfactants are selected from the group consisting of sultaines, fatty acid amido alkylhydroxy sultaines, alkylbetaines and mixtures thereof.

According to the present invention, particularly preferred surfactants are selected from the group consisting of sodium-alkylphenolethersulfates.

According to the present invention at least one hydrophilic liquid is in general a liquid that is completely miscible with water and forms only one phase with water. Examples of hydrophilic liquids according to the present invention are selected from the group consisting of water, alcohols like methanol, ethanol, propanols, for example n-propanol, isopropanol and mixtures thereof. Preferably, water is used as hydrophilic liquid.

The formation of magnetic agglomerates, i.e. the magnetic constituents which can be separated off by the apparatus of the invention, can also occur via other attractive interactions, for example via the pH-dependent zeta potential of the corresponding surfaces, see, for example, the International publications WO 2009/010422, and WO 2009/065802. Further methods for attaching magnetic particles and particles to be separated off include application of bifunctional molecules, like for example described in WO2010/007075. Another method for attaching magnetic particles and particles to be separated off include application of molecules being hydrophobic or hydrophilic depending on the temperature, like for example described in WO2010/007157.

In a preferred embodiment of the apparatus of the invention, the at least one first material which together with magnetic particles forms the magnetic constituents is at least one hydrophobic metal compound or coal and the at least one second material which forms the non-magnetic constituents is preferably at least one hydrophilic metal compound.

In a further preferred embodiment of the present invention, the at least one hydrophobic metal compound is selected from the group consisting of sulfidic ores, oxidic ores, carbonate-comprising ores, noble metals in elemental form, compounds comprising noble metals and mixtures thereof.

The present invention therefore preferably relates to the apparatus according to the present invention, wherein the at least one hydrophobic metal compound is selected from the group consisting of sulfidic ores, oxidic ores, carbonate-comprising ores, noble metals in elemental form, compounds comprising noble metals and mixtures thereof.

In a further preferred embodiment of the apparatus according to the present invention, the at least one hydrophilic metal compound is selected from the group consisting of oxidic metal compounds, hydroxidic metal compounds and mixtures thereof.

The present invention therefore preferably relates to the apparatus according to the present invention, wherein the at least one hydrophilic metal compound is selected from the group consisting of oxidic metal compounds, hydroxidic metal compounds and mixtures thereof.

Examples of the at least one first material to be separated off are preferably metal compounds selected from the group consisting of sufidic ores, oxidic and/or carbonate-comprising ores, for example azurite $[Cu_3(CO_3)_2(OH)_2]$ or malachite $[Cu_2[(OH)_2|[CO_3]]$, rare earth metals comprising ores like bastnaesite (Y, Ce, La)$CO_3F$, monazite (RE)$PO_4$, (RE=rare earth metal) or chrysocolla $(Cu,Al)_2H_2Si_2O_5(OH)_4.nH_2O$, noble metals in elemental form and their compounds to which a surface-modifying compound can become selectively attached to produce hydrophobic surface properties. Examples of noble metals that may be present as at least first material are Au, Pt, Pd, Rh, etc., preferably in the native state or as sulphides, phosphides, selenides, tellurides or as alloys with bismuth, antimony and/or other metals.

Examples of sulfidic ores which can be separated according to the invention are, for example, selected from the group of copper ores consisting of covellite CuS, molybdenum(IV) sulfide, chalcopyrite (cupriferous pyrite) $CuFeS_2$, bornite $Cu_5FeS_4$, chalcocite (copper glass) $Cu_2S$, pendlandite $(Fe, Ni)_9S_8$, and mixtures thereof.

Suitable oxidic metal compounds which may be present as at least one second material according to the invention are preferably selected from the group consisting of silicon dioxide $SiO_2$, silicates, aluminosilicates, for example feldspars, for example albite $Na(Si_3Al)O_8$, mica, for example muscovite $KAl_2[(OH,F)_2AlSi_3O_{10}]$, garnets $(Mg, Ca, Fe^{II})_3(Al, Fe^{III})_2(SiO_4)_3$, and further related minerals and mixtures thereof.

Accordingly, with the apparatus of the invention preferably ore mixtures which have been obtained from mine deposits and which have been treated with appropriate magnetic particles are treated.

In a preferred embodiment of the invention, the mixture comprising at least one first material and at least one second material is present in the form of particles having a size of from 100, nm to 200, μm; see, for example, U.S. Pat. No. 5,051,199. Preferred ore mixtures have a content of sulfidic materials of at least 0.01% by weight, preferably 0.5% by weight and particularly preferably at least 3% by weight.

Examples of sulfidic minerals which are present in the mixtures which can be treated according to the invention are those mentioned above. In addition, sulfides of metals other than copper can also be present in the mixtures, for example sulfides of iron, lead, zinc or molybdenum, i.e. $FeS/FeS_2$, PbS, ZnS or $MoS_2$. Furthermore, oxidic compounds of metals and semimetals, for example silicates or borates, or other salts of metals and semimetals, for example phosphates, sulfates or oxides/hydroxides/carbonates and further salts, for example azurite $[Cu_3(CO_3)_2(OH)_2]$, malachite $[Cu_2[(OH)_2(CO_3)]]$, barite $(BaSO_4)$, monazite $((La—Lu)PO_4)$, can be present in the ore mixtures to be treated according to the invention. Further examples of the at least one first material which is separated off with the apparatus of the invention are noble metals, for example Au, Pt, Pd, Rh etc., which can be present in the native state, as alloy or in associated form.

To form the magnetic constituents of the preferably aqueous dispersion to be treated according to the invention, the at least one first material from the abovementioned group is brought into contact with at least one magnetic particle in order to obtain the magnetic constituents by attachment or agglomeration. In general, the magnetic constituents can comprise all magnetic particles known to those skilled in the art.

In a preferred embodiment, the at least one magnetic particle is selected from the group consisting of magnetic metals, for example iron, cobalt, nickel and mixtures thereof, ferromagnetic alloys of magnetic metals, for example NdFeB, SmCo and mixtures thereof, magnetic iron oxides, for example magnetite, maghemite, cubic ferrites of the general formula (I)

$$M^{2+}{}_{x}Fe^{2+}{}_{1-x}Fe^{3+}{}_{2}O_4 \quad (I)$$

where

M is selected from among Co, Ni, Mn, Zn and mixtures thereof and $x \leq 1$, hexagonal ferrites, for example barium or strontium ferrite $MFe_6O_{19}$, where M=Ca, Sr, Ba, and mixtures thereof. The magnetic particles can additionally have an outer layer, for example of $SiO_2$.

In a particularly preferred embodiment of the present patent application, the at least one magnetic particle is magnetite or cobalt ferrite $Co^{2+}{}_{x}Fe^{2+}{}_{1-x}Fe^{3+}{}_{2}O_4$, where $x \leq 1$.

In a preferred embodiment, the magnetic particles used in the magnetic constituents are present in a size of from 100, nm to 200, μm, particularly preferably from 1, to 50, μm.

In the preferably aqueous dispersion to be treated in the apparatus according to the invention, the magnetic constituents, i.e. preferably magnetic particles and/or agglomerates of magnetic particles and at least one first material, are generally present in an amount which allows the aqueous dispersion to be transported or conveyed in the apparatus according to the invention.

The preferably aqueous dispersion to be treated according to the invention preferably comprises from 0.01, to 10% by weight, particularly preferably from 0.2, to 3% by weight, very particularly preferably from 0.5, to 1% by weight, of magnetic constituents, in each case based on the total dispersion.

In the preferably aqueous dispersion to be treated with the apparatus according to the invention, the non-magnetic constituents are generally present in an amount which allows the aqueous dispersion to be transported or conveyed in the apparatus according to the invention. The aqueous dispersion to be treated according to the invention preferably comprises from 3, to 50% by weight, particularly preferably from 10, to 45% by weight, very particularly preferably from 20, to 40% by weight, of non-magnetic constituents, in each case based on the total dispersion.

According to the invention, a preferably aqueous dispersion is treated in the apparatus according to the invention, i.e. the dispersion medium is essentially water, for example from 50, to 97% by weight, preferably from 55, to 90% by weight, very particularly preferably from 60, to 80% by weight, in each case based on the total dispersion. However, the apparatus can also be applied to nonaqueous dispersions or mixtures of solvents with water.

Thus, further dispersion media, for example alcohols such as methanol, ethanol, propanols, for example n-propanol or isopropanol, other organic solvents such as ketones, for example acetone, ethers, for example dimethyl ether, methyl tert-butyl ether, mixtures of aromatics such as naphtha or diesel or mixtures of two or more of the abovementioned solvents, can be present in addition to or instead of water. The dispersion media present in addition to water are present in an amount of up to 97% by weight, preferably up to 90% by weight, very particularly preferably up to 80% by weight, in each case based on the total dispersion.

The dispersion that is to be treated with the apparatus according to the present invention has a solid content of for example 3, to 50% by weight, preferably from 10, to 45% by weight.

The present invention therefore further relates to the apparatus according to the present invention, wherein the dispersion to be treated has a solid content of 3, to 50% by weight, preferably from 10 to 45% by weight.

The amounts indicated for the individual components present in the aqueous dispersion to be treated according to the invention in each case add up to 100% by weight.

In a very particularly preferred embodiment, an aqueous dispersion which does not comprise any further dispersion medium except water is treated with the apparatus of the invention.

In a preferred embodiment of the apparatus according to the present invention, the magnetic particles, in particular magnetite, that are separated according to the second embodiment of the present invention are recycled into the process for separating at least one first material from a mixture comprising this at least one first material and at least one second material. This preferred recycling makes it possible to run the process more economically and more environmentally friendly.

In a further preferred embodiment of the apparatus according to the present invention, the surfactaut, preferably an aqueous solution thereof that is preferably used as a hydrophobic liquid is recycled into the process for separating at least one first material from a mixture comprising this at least one first material and at least one second material. This preferred recycling makes it possible to run the process more economically and more environmentally friendly.

More preferred, the present invention relates to an apparatus according to the present invention, further comprising a means for recycling the hydrophobic liquid after treating the dispersion or a part of the dispersion therewith.

In a particularly preferred embodiment of the apparatus according to the present invention, both the magnetic particles that are separated according to the second embodiment of the present invention and the surfactant, preferably an aqueous solution thereof, that is preferably used as a hydrophobic liquid are recycled into the process for separating at least one first material from a mixture comprising this at least one first material and at least one second material. This preferred recycling makes it possible to run the process even more economically and more environmentally friendly.

A very specific feature of the apparatus according to the present invention is that it comprises at least one first means for treating the dispersion or a part of the dispersion with a hydrophilic liquid, and at least one second means for treating the dispersion or a part of the dispersion with a hydrophobic liquid.

These means are located in general at any place that is expected suitable by a person having ordinary skill in the art.

In the preferred first embodiment of the apparatus according to the present invention as mentioned above, the at least one second means for treating the dispersion or a part of the dispersion with a hydrophobic liquid is located at the at least one first outlet, which is used to separate the magnetic agglomerates. Within this embodiment the hydrophobic liquid is an aqueous solution of at least one surfactant. The dispersion that preferably comprises magnetic agglomerates at this point of the apparatus is treated with at least one hydrophobic liquid in order to start desagglomeration of the hydrophobic connected agglomerates to have the hydrophobic magnetic particle and the at least one first hydrophobic material separately to be treated in the preferred second embodiment.

According to a preferred embodiment of the first preferred embodiment of the apparatus according to the present invention, wherein preferably hydrophobic agglomerates of the at least one first material that is hydrophobic or treated to be hydrophobic and at least one magnetic particle that is hydrophobic or treated to be hydrophobic are separated from the at least one second hydrophilic material, the at least one first means (11) is located at the at least one first outlet (5) near by the at least one second outlet (6) for treating the hydrophobic magnetic agglomerates with a hydrophilic liquid to move hydrophilic nonmagnetic particles, which are hold within the bulk of hydrophobic magnetic agglomerates to the at least one second outlet (6).

The present invention therefore preferably relates to the apparatus according to the present invention, wherein the at least one first means is located at the at least one first outlet nearby the at least one second outlet for treating hydrophobic magnetic agglomerates with a hydrophilic liquid to move hydrophilic nonmagnetic particles, which are hold within the bulk of hydrophobic magnetic agglomerates to the at least one second outlet. Further preferred, further means may be located between the at least one second outlet and the at least one first means, according to this embodiment.

According to the present invention "located at" in general means that the corresponding means is located near, preferably directly adjacent the corresponding outlet or inlet. According to the present invention, it is possible that no or at least one further means is located between the corresponding means and the corresponding outlet or inlet.

According to the present invention "nearby" in general means a distance of the corresponding means to the corresponding outlet, preferably "nearby" means 1- to 10-fold, particularly preferably 2- to 8-fold, further preferably 4- to 6-fold the main dimension of the canal, in particular the width of the canal.

According to the present invention, the canal of the apparatus according to the present invention comprises a width of for example 1, to 80, mm, preferably 3, to 60, mm. According to a further preferred embodiment of the present invention the ratio of height to width of the canal of the apparatus according to the present invention is 1/1, to 1/10.

According to the present invention, the "outlet" means a part of the canal through which particles, magnetic and/or non-magnetic particles, are driven by, for example, current, gravity and/or magnetic forces. According to the present invention, the "outlet opening" means a part of the outlet, which is located at the very end of said outlet.

According to the present invention the wording "which forces the magnetic or non-magnetic particles" is understood in a way that the above mentioned forces, i.e. current, gravity and/or magnetic forces in addition to the design and dimensions of the canal and the corresponding outlets, outlet openings and means according to the present invention act on the above mentioned particles in a way that their direction is amended as desired.

According to a further preferred embodiment of the apparatus according to the first preferred embodiment of the apparatus according to the present invention, the at least one second means (12) is located at the at least one first outlet (5) nearby the outlet opening (5) for treating the hydrophobic magnetic agglomerates with a hydrophobic liquid to start desagglomeration of these agglomerates.

The present invention therefore preferably relates to the apparatus according to the present invention, wherein the at least one second means (12) is located at the at least one first outlet (5) nearby the outlet opening (5) for treating hydrophobic magnetic agglomerates with a hydrophobic liquid.

According to a particularly preferred embodiment of the apparatus according to said preferred first embodiment of the apparatus according to the present invention, the at least one hydrophobic magnetic agglomerate is at least one agglomerate of at least one hydrophobic magnetic particle and at least one first hydrophobic material, preferably at least one valuable of an ore that is hydrophobic or treated to be hydrophobic, and the at least one hydrophilic non-magnetic particle is at least one second material, preferably at least one gangue of said ore.

The present invention therefore preferably relates to the apparatus according to the present invention, wherein the at least one magnetic agglomerate is at least one agglomerate of at least one hydrophobic or hydrophobised magnetic particle and at least one first hydrophobic or hydrophobised material, preferably at least one valuable of an ore, and the at least one hydrophilic non-magnetic particle is at least one second material, preferably at least one gangue of said ore. Further preferred according to this embodiment of the apparatus according to the present invention, the at least one first means (11) is located at the at least one first outlet (5) nearby the at least one second outlet (6) for treating hydrophobic magnetic agglomerates with a hydrophilic liquid to move the at least one second hydrophilic material to the at least one second outlet (6).

The present invention therefore preferably relates according to the apparatus according to the present invention, wherein the at least one first means (11) is located at the at least one first outlet (5) nearby the at least one second outlet (6) for treating hydrophobic magnetic agglomerates with a hydrophilic liquid to move the at least one second hydrophilic material to the at least one second outlet (6).

According to a further preferred embodiment of the apparatus according to the present invention, the at least one second means (12) is located nearby the at least one first outlet (5) for treating the at least one hydrophobic agglomerate with a hydrophobic liquid to separate this at least one hydrophobic agglomerate into at least one first hydrophobic material and at least one hydrophobic magnetic particle to start the desagglomeration of those hydrophobic agglomerates and move them to the at least one first outlet (5).

The present invention therefore preferably relates to the apparatus according to the present invention, wherein the at least one second means (12) is located at the at least one first outlet (5) nearby the outlet opening (5) for treating the at least one hydrophobic agglomerate with a hydrophobic liquid to start the separation of this at least one hydrophobic agglomerate into at least one first hydrophobic material and at least one hydrophobic magnetic particle and move them to the at least one first outlet (5).

According to the first preferred embodiment, the addition of the at least one hydrophobic liquid, which is preferably an aqueous solution of at least one surfactant, can be conducted immediately or later after the magnetic separation of hydrophobic agglomerates of values and magnetic carrier particles from nonmagnetic constituents. In a preferred embodiment, the addition in the apparatus according to the present invention can be conducted in a way that intensive dispersion is obtained. In this preferred embodiment further means, for example stirring containers, are essentially not necessary anymore. If the addition of the hydrophobic liquid is conducted using an intensive dispersion, further dispersion in separate means can be avoided and the whole process can be conducted in a more economical way.

According to the preferred first embodiment the present invention therefore preferably relates to an apparatus according to the present invention, wherein the at least one second means for treating the dispersion or a part of the dispersion with a hydrophobic liquid is located at the at least one first outlet nearby the outlet opening.

In the preferred first embodiment of the apparatus according to the present invention, the at least one first means for treating the dispersion or a part of the dispersion with a hydrophilic liquid is located at the at the at least one first outlet and near by the at least one second outlet, that is preferably used to remove the hydrophilic non-magnetic material, being preferably the at least one second material, from the dispersion. The treatment with at least one hydrophilic liquid at this point of the apparatus is conducted to flush the stream of hydrophobic magnetic constituents from hydrophilic non-magnetic material and to move this non-magnetic material into the at least one second outlet. This has to be done by hydrophilic liquid to keep the hydrophobic agglomerates of values and magnetic carrier particles together.

The present invention therefore preferably relates to an apparatus according to the present invention, wherein the at least one first means for treating the dispersion or a part of the dispersion with a hydrophilic liquid is located at the at least one first outlet and near by the at least one second outlet followed by at least one second means for treating the dispersion or a part of the dispersion with a hydrophobic liquid located at the least first outlet nearby the outlet opening of the at least first outlet.

In a preferred embodiment of the first embodiment of the present invention, the hydrophobic magnetic agglomerates shall not be separated, i. e. not to be removed through the at least one first outlet, before the hydrophilic non-magnetic parts are separated, i. e. are removed through the at least one second outlet. This can be achieved by a further preferred embodiment of this first embodiment, wherein another first means for treating the dispersion or at least part of the dispersion with at least one hydrophilic liquid is present to create intensive dispersion, i.e. by a nozzle to get higher shear forces to separate hydrophilic nonmagnetic particles from hydrophobic magnetic agglomerates, preferably between the means for treating the dispersion or at least part of the dispersion with at least one hydrophilic liquid and the means for treating the dispersion or at least part of the dispersion with at least one hydrophobic liquid.

According to the second preferred embodiment of the apparatus according to the present invention, wherein preferably at least one first hydrophobic material is separated at hydrophobic environment that could be a hydrophobic liquid from the at least one hydrophobic magnetic material that is added to obtain hydrophobic magnetic agglomerates , further embodiments are preferred that are explained in the following:

According to a preferred embodiment of the preferred second embodiment of the apparatus according to the present invention, the at least one second means (12) is located at the at least one first outlet (5) nearby the at least one second outlet (6) for treating the at least one hydrophobic magnetic particle with a hydrophobic liquid to move nonmagnetic first hydrophobic material, which is hold within the bulk of hydrophobic magnetic particles, to the at least one second outlet (6).

The present invention therefore preferably relates to the apparatus according to the present invention, wherein the at least one second means (12) is located at the at least one first outlet (5) nearby the at least one second outlet (6) for treating the at least one hydrophobic magnetic particle with a hydrophobic liquid to move nonmagnetic hydrophobic first material, which is hold within the bulk of hydrophobic magnetic particles, to the at least one second outlet (6).

According to a further preferred embodiment of the preferred second embodiment of the apparatus according to the present invention, the at least one first means (11) is located at the least one first outlet (5) nearby the outlet opening of the at least one first outlet (5) for treating the at least one hydrophobic magnetic particle with a hydrophilic liquid to recycle it to the hydrophilic environment of the process and move it to the at least one first outlet (5).

The present invention therefore preferably relates to the apparatus according to the present invention, wherein the at least one first means (11) is located at the least one first outlet (5) nearby the outlet opening of the at least one first outlet (5) for treating at least one magnetic particle with a hydrophilic liquid to recycle it to the hydrophilic environment of the process and move it to the at least one first outlet (5).

According to the preferred second embodiment of the apparatus according to the present invention as mentioned above, the at least one means for treating the dispersion or a part of the dispersion with a hydrophilic liquid is preferably located at the at least one first outlet nearby the outlet opening, which is used to separate the magnetic particles. Within this embodiment the hydrophilic liquid is preferably water. The separated magnetic fraction can be transported with water in order to avoid that hydrophobic liquid is transported with the magnetic particles. If hydrophobic liquid is transported with the magnetic particles the further process with agglomeration of the recycled hydrophobic magnetic particles and the hydrophobic values would be disturbed.

The present invention therefore preferably relates to an apparatus according to the present invention, wherein the at least one means for treating the dispersion or a part of the dispersion with a hydrophilic liquid is located at the end of the at least one first outlet, further preferably the at least one first means is located nearer to the end of the at least one first outlet than a at least one second means for treating the dispersion or a part of the dispersion with a hydrophobic liquid that is preferably also present near the at least one second outlet.

Therefore, according to a further preferred second embodiment of the apparatus according to the present invention, the at least one means for treating the dispersion or a part of the dispersion with a hydrophobic liquid is located at the at least one first outlet near by the at least one second outlet, that is preferably used to remove the hydrophobic non-magnetic material, being preferably the at least one first hydrophobic material in this second embodiment, from the dispersion.

If the magnetic particles are hydrophobic magnetic particles themselves, for example magnetite that is treated to be hydrophobic, the addition of a hydrophilic liquid shall be avoided in order not to achieve hydrophobic connected agglomerates of the hydrophobic magnetic particles and the hydrophobic values in a hydrophilic environment. Therefore, flushing of the magnetic particles should preferably be conducted with a hydrophobic liquid at this point of the apparatus according to this second embodiment. Within this embodiment the hydrophobic liquid is an aqueous solution of at least one surfactant.

Further preferred in this second embodiment is that a second means for treating the dispersion or at least part of the dispersion with at least one hydrophobic liquid is present to flush the hydrophobic magnetic particles at high intensity to free included nonmagnetic hydrophobic first material out of the bulk i.e. by using a nozzle, preferably between the means for treating the dispersion or at least part of the dispersion with at least one hydrophobic liquid and the means for treating the dispersion or at least part of the dispersion with at least one hydrophilic liquid. This intensive flushing has to be done by hydrophobic liquid to avoid, that hydrophobic agglomerates are built, like done in hydrophilic liquids. Within this embodiment the second hydrophobic liquid is an aqueous solution of at least one surfactant, too.

According to both preferred embodiments of the apparatus according to the present invention, the at least one first or second means to treat the dispersion or part of the dispersion with hydrophobic or hydrophilic liquids are preferably a high intensity dispersing unit, preferably with entrance velocities from 0.5, to 10, m/s, more preferably 1, to 5, m/s, most preferably 2, to 4, m/s.

The present invention therefore preferably relates to the apparatus according to the present invention, wherein the at least one first or second means to treat the dispersion or part of the dispersion with hydrophobic or hydrophilic liquids are preferably a high intensity dispersing unit, preferably with entrance velocities from 0.5, to 10, m/s, preferably 1, to 5, m/s, most preferably 2, to 4, m/s.

Furthermore, according to both preferred embodiments of the apparatus according to the present invention, the at least one of the at least one first or second means to treat the dispersion or part of the dispersion, preferably the magnetic fraction, with hydrophilic or hydrophobic liquids is created, preferably designed, in any way to get a flow that is arranged with an angle of 30, to 150°, preferably 90°, to the flow in the canal, preferably the main axis of the at least one of the at least one first or second means to treat the dispersion or part of the dispersion, preferably the magnetic fraction, with hydrophilic or hydrophobic liquids is arranged with an angle of 30, to 150°, preferably 90°, to the main axis of the canal, wherein the main axis of the canal corresponds to a circular arc according to the form of the canal.

The present invention therefore preferably relates to the apparatus according to the present invention, wherein the at least one of the at least one first or second means to treat the magnetic fraction with hydrophilic or hydrophobic liquid is created in any way to get a flow that is arranged with an angle of 30, to 150°, preferably 90°, to the flow in the canal, more preferably in the apparatus according to the present invention the main axis of the at least one of the at least one first or second means to treat the dispersion or part of the dispersion, preferably the magnetic fraction, with hydrophilic or hydrophobic liquids is arranged with an angle of 30, to 150°, preferably 90°, to the main axis of the canal.

The apparatus of the invention comprises at least one loop-like canal forming 90, top 350° of a circular arc through which the dispersion flows having at least two outlets. In general the apparatus according to the present invention further has at least one inlet.

According to the present invention the wording "canal" describes the body structure of the apparatus. According to the present invention the wording "canal" describes an apparatus, which is, in its easiest embodiment, formed by a tube, e. g. the canal according to the invention has a length that is larger than the breadth or diameter of the canal. The cross-section of the canal can have any suitable shape, for example oval, annular, circular, square, rectangular, irregular or a combination of these shapes, preferably square or rectangular.

The loop-like canal forming 90, to 350° of a circular arc according to the invention is designed to be able to separate magnetic constituents from nonmagnetic constituents in laboratory or industrial scale, preferably industrial scale. According to the present invention, an assembly of canals is defined as a reactor and can have an exemplary volume flow through the reactor of at least 350, $m^3/h$, preferably at least 700, $m^3/h$, particularly preferably at least 1000, $m^3/h$.

According to the invention the canal is formed loop-like and forms 90, to 350° of a circular arc. According to the invention "loop-like" describes a canal, which, in a simple embodiment, is formed like a loop. According to the present invention the loop-like canal forms 90, to 350° of a circular arc, for example at least 120°, more preferably at least 180°, in particular at least 270°, of a circular arc. According to the present invention the loop-like canal according to the present invention forms up to 350° of a circular arc which means that the canal does not cross itself or returns into itself. In a further preferred embodiment of the apparatus according to the present invention, the at least first inlet is present at one end of the loop-like canal and the at least one first outlet is present at the other end of the loop-like canal, and the at least one second outlet is present between the at least one inlet and the at least one first outlet.

The diameter of the loop that is constituted by the loop-like canal can be of any suitable size, for example 0.5, to 5, m, preferably 0.8, to 3.5, m, particularly preferably 1.2, to 2.5, m. With these general and preferred diameters, a length of the loop-like canal, specifically a length of magnetic separation is for example 1.25, to 12.5, m, preferably 2, to 9, m, particularly preferably 3, to 6, m.

Preferably, the loop-like canal forming 90, to 350° of a circular arc through which the dispersion flows has at least one inlet and at least two outlets. In a preferred embodiment, the loop-like canal forming 90, to 350° of a circular arc through which the dispersion flows has one first inlet through which the dispersion comprising magnetic and nonmagnetic constituents is introduced into the canal, and two outlets. Through the first of these outlets the magnetic constituents are removed from the canal. Through the second of these outlets the nonmagnetic constituents are removed from the canal. Through one second inlet the flushing liquid is brought to the current of magnetic constituents to rearrange them and to free the stored nonmagnetic constituents therein. According to the present invention, further inlets and/or outlets may be present.

The present invention preferably relates to an apparatus according to the present invention, wherein the magnetic particles are forced through at least one first outlet by the magnetic field of the at least one magnet, and the non-magnetic particles are forced through at least one second outlet by the current of the dispersion.

Inlets and outlets that are present in the canal of the present invention can be realized according to all embodiments known to the skilled artisan, for example tubings in suitable sizes, for example equipped with pumps, valves, means for controlling and adjusting etc.

The apparatus according to the present invention further comprises at least one magnet that is movable alongside the canal.

The at least one magnet may be installed in a movable fashion alongside the outside or alongside the inside, preferably alongside the outside, of the loop-like canal.

Therefore, the present invention preferably relates to the apparatus according to the present invention, wherein the at least one magnet is installed in a movable fashion alongside the outside of the loop-like canal.

This preferred embodiment serves to move the at least one magnet in the longitudinal direction of the loop-like canal in order to separate the magnetic constituents from the nonmagnetic constituents. With the at least one movable magnet the magnetic constituents which are attracted by the magnetic field are likewise moved in the corresponding direction, being the at least one first outlet.

The apparatus of the invention can be operated by the at least one magnet or the magnetic field produced and the preferably aqueous dispersion to be separated moving in the same direction. In this embodiment, the reactor is operated in concurrent. This embodiment is preferred.

In a further preferred embodiment of the apparatus of the invention, the at least one magnet or the magnetic field produced move in the opposite direction to the preferably aqueous dispersion to be separated. In this preferred embodiment, the apparatus of the invention is operated in countercurrent.

The present invention therefore relates to the apparatus according to the present invention, wherein the flow of the dispersion and the moving direction of the at least one magnet are concurrent.

In the countercurrent mode of operation according to the invention, care should be taken to ensure that movement of the magnetic constituents, preferably as a compact mass, in the direction opposite to the flow of the dispersion to be treated due to the at least one magnet does not occur in the feed line, i. e. the at least one first inlet, for the dispersion to be treated. In this case, blockages could occur in this region.

With the apparatus of the invention, a flow velocity of the aqueous dispersion to be treated of for example ≥200, mm/s, preferably ≥400, mm/s, particularly preferably ≥600, mm/s, is accomplished. These high flow velocities ensure that no blockages occur in the apparatus of the invention, in particular in countercurrent operation.

The magnets used according to the invention can be any magnets known to those skilled in the art, for example permanent magnets, electromagnets and combinations thereof. Low intensity permanent magnets are preferred, because the amount of energy that is consumed by the apparatus according to the invention can be decreased essentially, compared to the use of electro magnets. With this preferred embodiment a particular energy saving apparatus and process are obtained.

The at least one magnet is installed in any possible way known to the skilled artisan at the loop-like canal as long as it is movable alongside the canal, for example by a conveyor belt, by a drum as holder for the at least one magnet or other rotatable constructions to hold the at least one magnet. In a preferred embodiment the at least one magnet is attached to and moved by a drum.

The present invention therefore also relates to the apparatus according to the invention, wherein the at least one magnet is moved during operation by a drum.

In a preferred embodiment, a multiplicity of magnets is arranged around the loop-like canal. The number of magnets depends on the size of the single magnets and on the size of the loop-like canal. An exemplary number of magnets that are arranged around the loop-like canal is 40, preferably 60.

The polarities of the magnets that are preferably arranged around the loop-like canal can be adjusted in any possible way. For example, all polarities of the magnets can be adjusted in the same direction. According to another embodiment, the polarities of the magnets are adjusted alternately. In a preferred embodiment the magnets are adjusted with an alternating sequence of, for example, each 3, magnets with same direction of polarity followed by, for example, one magnet with alternated polarity.

The at least one magnet and the loop-like canal are arranged in a way that the gap between the outside wall of the canal and the at least one magnet is suitable to obtain an advantageous magnetic field at a location inside the canal where the magnetic constituents shall be collected, preferably at the inside of the outside wall of the canal. An exemplary gap between the outside wall of the canal and the at least one magnet is minimized to less than 2, mm to use maximum force of the at least one magnet.

The distance over that the magnetic forces act to the magnetic constituents is limited by the behaviour of the at least one magnet. An exemplary distance that determines the height of the canal, using low intensity standard magnets could be 80, mm, preferably 60, mm, very particularly preferable 40, mm. Therefore the height of the canal could be in a range of 20, to 100, mm, preferable 40, to 80, mm, for example 65, mm.

As long as the essential features of the apparatus of the invention are complied with, the apparatus of the invention may have any further configuration. In a preferred embodiment it shall be ensured that the preferably aqueous dispersion to be separated has sufficient contact with the at least one magnet installed on the outside of the reactor space or the magnetic field produced by this at least one magnet.

Further details of canals that can be used in accordance with the present invention are known to those skilled in the art and are described, for example, in process engineering textbooks.

The apparatus itself and/or the loop-like canal, according to the invention can in principle be arranged in any orientation which appears suitable to a person skilled in the art and allows a sufficiently high separating power of the process of the invention. In a preferred embodiment, the tubular reactor is arranged relative to gravity in a way that nonmagnetic constituents are assisted to go into the at least one second outlet by sedimentation and by the current of the dispersion and magnetic constituents are forced into at least one first outlet by magnetic force against a current of flushing liquid.

In a preferred embodiment of the present invention, the apparatus and/or the loop-like canal according to the present invention are arranged vertically. According to the present invention, a "vertical arrangement" means that the loop-like canal is arranged in a way that dispersion, which is flowing through the loop-like canal, flows up and down, i.e. vertically, but essentially not from one side to another side, i.e. horizontally.

In general, the individual streams in the apparatus of the invention can be conveyed by gravity and/or by means of the apparatuses known to those skilled in the art, for example pumps.

The present invention therefore preferably relates to the apparatus according to the present invention, wherein the current of the dispersion is accomplished by at least one pump.

The preferred feature of the apparatus of the invention that the loop-like canal is arranged relative to gravity in a way that nonmagnetic constituents are assisted to go into the at least one second outlet by sedimentation and by the current of the dispersion and magnetic constituents are forced into at least one first outlet by magnetic force can be accomplished by all provisions known to the skilled artisan. In a preferred embodiment of the apparatus according to the invention, the loop-like canal is placed in a way that the closed end of the loop is pointing up, whereas the open end of the loop is pointing down. In a preferred embodiment, the at least one inlet and the at least two outlets are present at the open end of the loop.

In a further preferred embodiment of the apparatus according to the present invention, the loop-like canal is arranged vertically with the open end of the loop at the bottom.

In a further preferred embodiment, the open end of the loop is rotated laterally along its perpendicular, preferably in radial direction, by 1, to 90°, preferably 30, to 60°. This rotation is preferably accomplished into the direction giving rise to the at least two outlets in a way that sedimented non-magnetic constituents are going from the wall, where they are sedimented, directly to the at least one second outlet.

According to the invention a single apparatus as explained above can be used in order to separate magnetic constituents from a dispersion comprising magnetic constituents and non-magnetic constituents.

In a preferred embodiment of the present invention, more than one apparatus according to the present invention can be arranged and operated in parallel. This means that the dispersion to be separated is flowing through more than one canal according to the invention at the same time. In a preferred embodiment at least two canals are arranged and operated in parallel.

The present invention therefore preferably relates to an apparatus according to the present invention, wherein at least two canals are arranged and operated in parallel. In a further preferred embodiment at least 30, particularly preferably 100, further preferably at least 200, canals according to the invention are arranged and operated in parallel.

A person having ordinary skill in the art does know how these canals are connected, in order to have them arranged and operated in parallel. In a preferred embodiment all at least two outlets of all canals present are connected in each case to give at least two common outlets. In a further preferred embodiment all at least two inlets of all apparatuses present are connected in each case to give at least two common inlets. The skilled artisan knows how these connections shall be accomplished. For example, in order to have comparable pressure at all locations in the apparatus formed by more than one canal according to the invention, the diameter of common inlets and/or outlets can be adjusted.

In a preferred embodiment, the magnetic constituents present in the dispersion accumulate at least in part, preferably in their entirety, i.e. in a proportion of at least 60% by weight, preferably at least 90% by weight, particularly preferably at least 99% by weight, on the side of the loop-like canal facing the at least one magnet as a result of the magnetic field.

According to the present invention a means for treating the dispersion or at least a part of the dispersion can in general be provided in any way that is known to the skilled artisan, for example a valve, an orifice, a nozzle or only a tube. In a preferred embodiment, the means for treating the dispersion or at least a part of the dispersion are provided in a way that a flushing stream of hydrophobic or hydrophilic liquid is created that preferably rearranges the magnetic constituents to free the nonmagnetic particles within.

According to the present invention an outlet can in general be provided in any way that is known to the skilled artisan, for example as a simple junction in the loop-like canal. In this embodiment, the diameter of the outlet can be greater, smaller or identical to the diameter of the loop-like canal.

In a addition to the means that are explained and defined in detail above, the apparatus may further have means that are known to the skilled artisan to be necessary to operate such an apparatus, like tubing, motors, pumps, electrical equipment, valves and means for controlling and adjusting.

The present invention further relates to a process for the separation of at least one magnetic particle from a dispersion comprising this at least one magnetic particle and at least one non-magnetic particle in an apparatus according to the present invention.

Preferably, the present invention relates to the process according to the present invention, wherein the hydrophobic liquid that is used is recycled into the process after separation from solid contents.

The present invention further relates to the use of the apparatus according to the present invention for separating magnetic particles from a dispersion comprising these magnetic particles and non-magnetic particles.

Preferably, the present invention relates to the use according to the present invention, wherein the magnetic particles are magnetic particles themselves or agglomerates of magnetic particles and non-magnetic particles.

Details and preferred embodiments that have been explained in respect of abovementioned apparatus apply accordingly for the use and process according to the present invention.

FIGURES

Figure 2:
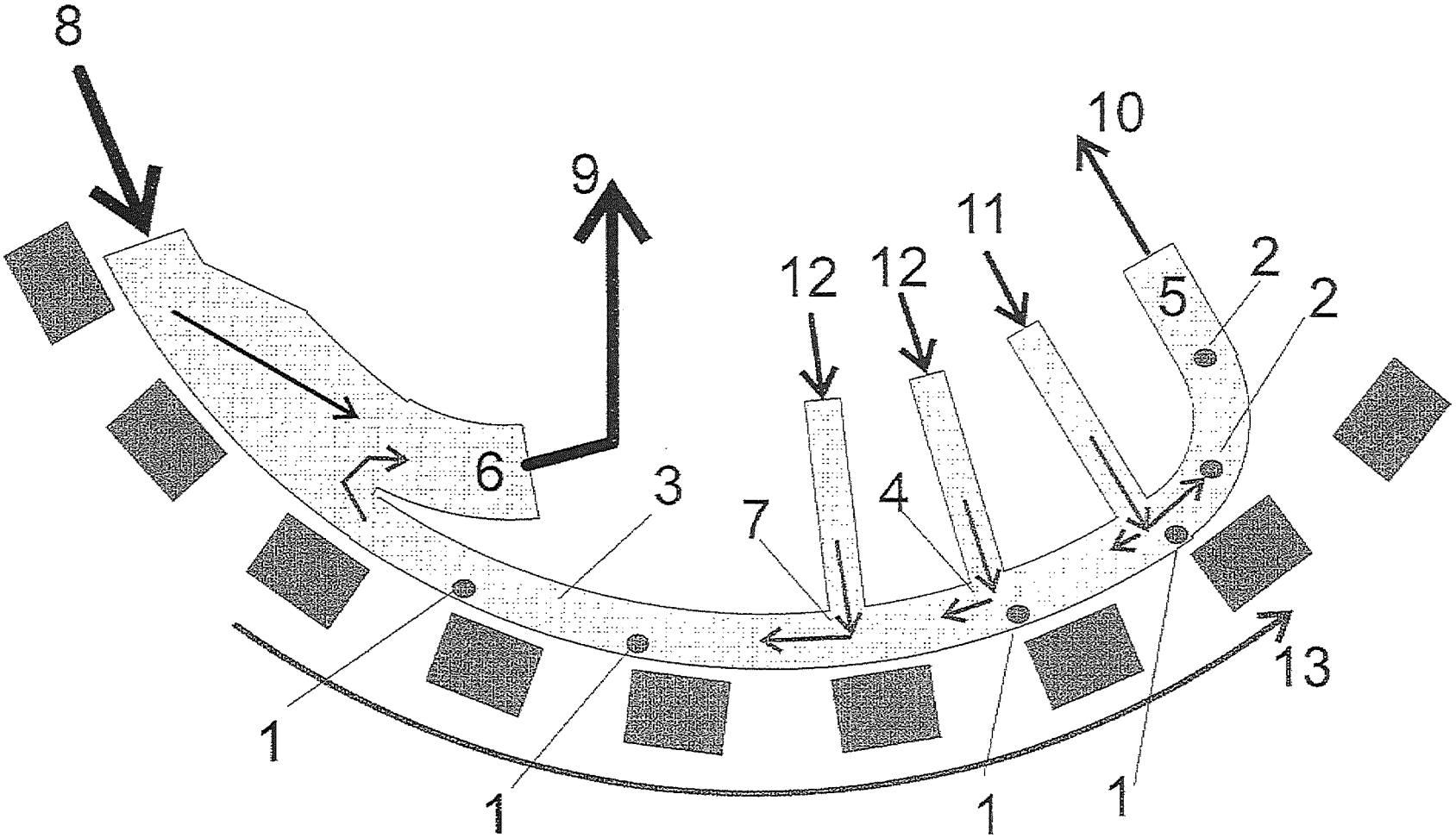

FIG. 1 shows the principal of an apparatus according to the present invention, wherein hydrophobic magnetic agglomerates are separated from non-magnetic hydrophilic particles according to the preferred first embodiment. FIG. 2 shows the principal of an apparatus according to the present invention, wherein hydrophobic magnetic particles are separated from non-magnetic hydrophobic particles according to the preferred second embodiment. Both FIGS. 1 and 2 show the parts of the apparatus according to the present invention, where means and outlets are located, wherein the entries where the magnetic fraction is introduced (10) and outlets (5) shall be prolonged to form at least 90° and at most 350° of a circular arc. The references in FIGS. 1 and 2 have the following meanings:

1 magnetic agglomerates or particles moved by magnets
2 magnetic agglomerates or particles moved by fluid flow (=output of clean magnetic fraction)
3 counter current flow area (=output of non-magnetic particles from magnetic fraction)
4 dispersing zone (separation of magnetic agglomerates/particles from non-magnetic particles)
5 first outlet
6 second outlet
7 intensive dispersing zone (separation of magnetic agglomerates/particles from non-magnetic particles)
8 from magnetic separation zone
9 nonmagnetic fraction
10 magnetic fraction
11 hydrophilic flush stream, first means
12 hydrophobic flush stream, second means
13 moved magnets

The invention claimed is:

1. An apparatus for separating magnetic particles from a dispersion comprising magnetic particles and non-magnetic particles, the apparatus comprising:

at least one arcuate canal forming 90° to 350° of a circular arc through which the dispersion flows, at least one magnet that is movable adjacent to the arcuate canal and which forces the magnetic particles toward at least one first outlet and to exit the canal, at least one second outlet through which the non-magnetic particles exit the canal, at least one hydrophilic input for treating the dispersion, or a part of the dispersion, with a hydrophilic liquid, and at least one hydrophobic input for treating the dispersion, or a part of the dispersion, with a hydrophobic liquid, wherein the hydrophobic input is located at the at least one first outlet nearby the first outlet opening.

2. The apparatus according to claim 1, wherein the at least one hydrophilic input is located at the at least one first outlet nearby the at least one second outlet for treating magnetic particles with a hydrophilic liquid to move non-magnetic particles, which are held within a bulk of magnetic particles to the at least one second outlet.

3. The apparatus according to claim 1, wherein the hydrophobic liquid is selected from the group consisting of aqueous solutions of surfactants, alcohols with alkyl-chains of 4 to 18 carbons, and mixtures thereof.

4. The apparatus according to claim 1, wherein the magnetic particles include hydrophobic bound agglomerate of magnetic particles of an ore, and the non-magnetic a gangue of said ore.

5. The apparatus according to claim 1, further comprising at least one is hydrophobic input located at the at least one first outlet nearby the at least one second outlet for treating the magnetic particle magnetic particles with a hydrophobic liquid to move nonmagnetic material that is held within the bulk of magnetic particles to the at least one second outlet.

6. The apparatus according to claim 1, wherein the at least one hydrophilic input, or the at least one hydrophobic input, to treat the dispersion or part of the dispersion with hydrophobic or hydrophilic liquids, respectively, is a high intensity dispersing unit with entrance velocities from 1 to 5 m/s.

7. The apparatus according to claim 1, wherein at least one hydrophilic input, or the at least one hydrophobic input, used to treat the dispersion or part of the dispersion, is arranged with an angle of 30 to 150° , to the flow in the canal.

8. A process for the separation of magnetic particles from a dispersion comprising magnetic particle and non-magnetic particles, the process comprising;

introducing the dispersion to the apparatus according to claim 1, providing the hydrophilic liquid that is added to the at least one hydrophilic input, and providing the hydrophobic liquid that is added to the at least one hydrophobic input.

9. The process according to claim 8, wherein the hydrophobic liquid used for treating the dispersion is recycled to the hydrophobic input following separation from solid contents.

10. An apparatus for separating magnetic particles from a dispersion comprising magnetic particles and non-magnetic particles, the apparatus comprising:

at least one arcuate canal forming 90° to 350° of a circular arc through which the dispersion flows, at least one magnet that is movable adjacent to the arcuate canal and which forces the magnetic particles toward at least one first outlet and to exit the canal, at least one second outlet through which the non-magnetic particles exit the canal, at least one hydrophilic input for treating the dispersion, or a part of the dispersion, with a hydrophilic liquid, wherein the hydrophilic input is located at the least one first outlet nearby an opening of the at least one first outlet to move nonmagnetic material to the second outlet, and at least one hydrophobic input for treating the dispersion, or a part of the dispersion, with a hydrophobic liquid, wherein the hydrophobic input is located at the least one first outlet nearby the at least one second outlet for treating hydrophobic magnetic particles with a hydrophobic liquid to move nonmagnetic hydrophobic material to the second outlet.

11. The apparatus according to claim 10, wherein the at least one hydrophilic input, or the at least one hydrophobic input, to treat the dispersion or part of the dispersion with hydrophobic or hydrophilic liquids, respectively, is a high intensity dispersing unit with entrance velocities from 1 to 5 m/s.

12. The apparatus according to claim 1, wherein the diameter of the arcuate canal is from 0.8 m to 3.5 m, and the length of the canal is from 2 m to 9 m.

13. The apparatus according to claim 10, wherein the diameter of the arcuate canal is from 0.8 m to 3.5 m, and the length of the canal is from 2 m to 9 m.

14. The apparatus according to claim 1, wherein the at least one magnet moves along the outside perimeter of the arcuate canal in a direction opposite to the flow direction of the dispersion in the canal.

15. The apparatus according to claim 10, wherein the at least one magnet moves along the outside perimeter of the arcuate canal in a direction opposite to the flow direction of the dispersion in the canal.

16. The apparatus according to claim 14, wherein the flow velocity of the dispersion in the canal is at least 400 mm/s.

17. The apparatus according to claim 15, wherein the flow velocity of the dispersion in the canal is at least 400 mm/s.

* * * * *